US005440293A

United States Patent [19]

Tice

[11] Patent Number: 5,440,293

[45] Date of Patent: Aug. 8, 1995

[54] DETECTOR SUPERVISION APPARATUS AND METHOD

[75] Inventor: Lee D. Tice, Bartlett, Ill.

[73] Assignee: Pittway Corporation, St. Charles, Ill.

[21] Appl. No.: 891,286

[22] Filed: May 29, 1992

[51] Int. Cl.[6] ..... G08B 13/14

[52] U.S. Cl. ..... 340/568; 340/506; 340/511

[58] Field of Search ..... 340/568, 687, 660, 663, 340/666, 514, 825.06, 825.16, 825.17, 506, 511; 324/654, 658; 439/917; 307/130; 200/85 R; 361/86, 88, 92

[56] References Cited

U.S. PATENT DOCUMENTS

| | | | |
|---|---|---|---|
| 4,228,734 | 10/1980 | Schultz | 340/512 |
| 4,369,435 | 1/1983 | Adachi et al. | 340/506 |
| 4,524,349 | 6/1985 | Hyatt | 340/506 X |
| 4,536,748 | 8/1985 | Tonello | 340/506 |
| 4,536,751 | 8/1985 | Shigemitsu et al. | 340/511 X |
| 4,544,921 | 10/1985 | Fujisawa | 340/584 |
| 4,567,471 | 1/1986 | Acar | 340/511 X |
| 4,716,401 | 12/1987 | Wohlford et al. | 340/568 |
| 4,829,283 | 5/1989 | Spang et al. | 340/506 |
| 4,833,451 | 5/1989 | Lehmann et al. | 340/511 X |

FOREIGN PATENT DOCUMENTS 2101784 1/1983 United Kingdom .

*Primary Examiner*—John K. Peng
*Assistant Examiner*—Thomas J. Mullen, Jr.
*Attorney, Agent, or Firm*—Dressler, Goldsmith, Shore & Milnamow, Ltd.

[57] ABSTRACT

A detector supervision system usable with detectors or sensors formed with a removable head and a surface mountable base includes an energy storage device which is carried on each base. The energy storage device is either a capacitor or an inductor, and is coupled to one or more of the terminals of the base. A conducting spring member is also carried on the base, attached to one of the terminals. The spring member is in a first position when the head is attached to the base. The spring member moves to the second position in response to the head being removed from the base. Detection circuitry can detect the presence of one or more energy storage devices which are switched into communication lines between detector bases in response to one or more of the heads being removed. The detection circuitry can signal a central control panel that one or more of the heads has been removed from a respective base.

10 Claims, 2 Drawing Sheets

DETECTOR SUPERVISION APPARATUS AND METHOD

FIELD OF THE INVENTION

The invention pertains to multiple detector alarm systems wherein at least some of the detectors have a surface-mountable base and a detecting head which removably engages the base. More particularly, the invention pertains to an apparatus and method for detecting the removal of one or more of the heads while enabling the associated alarm system to keep functioning.

BACKGROUND OF THE INVENTION

Centralized alarm control panels, along with associated detection systems, are often provided in monitoring systems for large buildings or building complexes. One aspect of the functionality of the alarm control panel is to supervise each of a plurality of sensor units or detectors which are located throughout the building or the building complex.

The units are conventionally connected to the alarm control panel by two or more conductors. It has become a preferred practice to combine electrical power transmission and information transmission onto a single pair of conductors.

In addition, it has become desirable to form the sensor or detector units as two part devices. One part is a base which is surface mountable and which is hard-wired into the two wire cable of the monitoring system. A plug-in head or detector is arranged for being removably attachable to the base.

The use of plug-in sensor or detector units facilitates both installation and long term maintenance. One problem with the use of removable detector heads lies in the fact that they are removable. If a detector or a sensor head is removed, the alarm control panel loses the ability to sense combustion or intrusion in the area or region covered by the missing detector or sensor. In addition, a missing head could disrupt operation of the entire system.

As a result, it has been recognized that it is important that the alarm control panel be able to not only function properly where one or more of the sensor or detector heads is missing, but also to be able to detect the removal of the sensor or detector head. One arrangement for enabling the control panel to continue to work properly in the absence of one or more detectors uses a spring structure as disclosed in Spang et al., U.S. Pat. No. 4,829,283, assigned to the assignee of the present invention.

There continues to be a need for supervision devices which not only make possible the continued operation of an alarm system in response to a detector or sensor head being removed, but also provide a capability for detecting the fact that one or more sensor or detector units have been removed. Preferably, such a device would not increase the cost or complexity of the base assembly, but yet would provide the capability of informing the control panel that one or more detector or sensor heads had been removed.

SUMMARY OF THE INVENTION

A surface-mountable base usable with a removable detector head includes a mounting member to which the head can be removably attached. The base includes at least first and second terminals.

An energy storage device is carried on the base attached to at least one of the terminals. In one embodiment of the invention, the energy storage device includes a capacitor electrically coupled to one terminal. In another embodiment, the energy storage device includes an inductor coupled to two terminals.

A conducting spring member having first and second positions is carried on the base attached to one of the terminals. The spring member is in the first position when the head is attached to the base. The spring member moves to the second position in response to the head being removed from the base.

A plurality of bases can be electrically coupled together by elongated conductors to form a detector system. The removal of one or more of the detector heads can be remotely sensed without affecting the operation of the remaining detector heads.

If desirable, the head, when installed, can be used to make the contact normally made by the spring member. In this embodiment, a separate spring member would not be needed.

The above-described structure is advantageous in that no modifications need be made to the associated system control panel. Hence, it can be readily installed in an existing system. In addition, the end-of-line circuit is both relatively inexpensive and readily adaptable to varying requirements of pre-existing control panels. Finally, the above apparatus is completely transparent to normal or pre-existing system operations.

These and other aspects and attributes of the present invention will become increasingly clear upon reference to the following drawings and accompanying specification.

DETAILED DESCRIPTION OF THE PREFERRED EMBODIMENT

Figure 1:
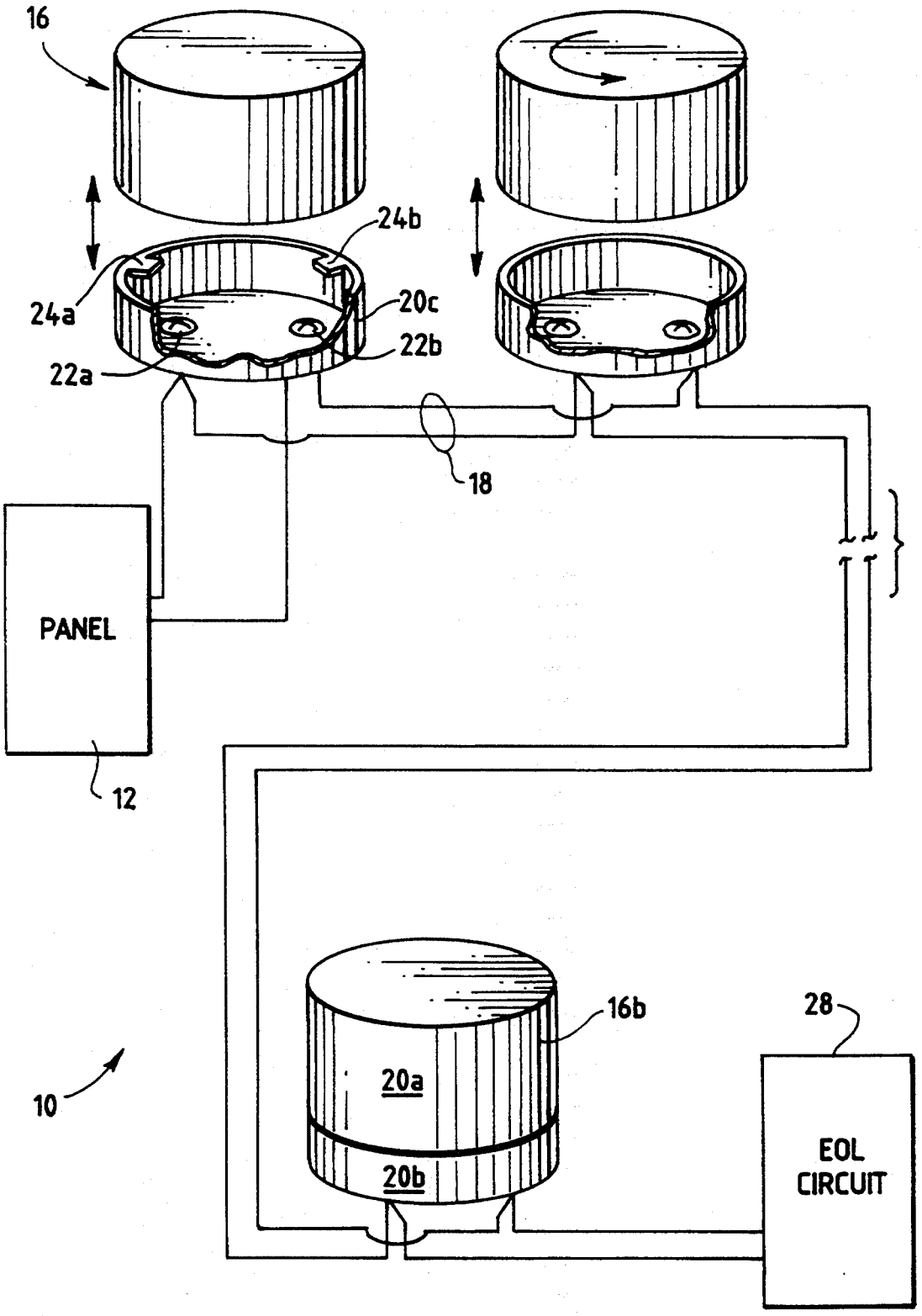
FIG. 1 is an overall diagram of a detector system in accordance with the present invention.

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

A system 10 which embodies the present invention is illustrated in FIG. 1. The system 10 incudes a central control panel 12, which transmits electrical energy, information and commands to, and receives information from a plurality of detector units 16 by means of a two-conductor communication cable 18.

The members of the plurality 16, such as a member **16*a*, each include a sensor or detector head 20*a* and a base 20*b*. The base 20*b* can be a surface mountable member, which carries first and second terminals, such as terminals 22*a* and 22*b*. The terminals 22*a*, 22*b* can be coupled to the conductors 18**.

The sensor or detector head 20*a* releasably engages the base 20*b* by means of snap-fit or releasable tabs, such as tabs 24*a*, 24*b*. The above-identified Spang et al. patent discloses one arrangement for releasably locking the sensor or detector head to the base.

It will be understood that the exact details of the locking mechanism between the head and the base are not a limitation of the present invention. On the base 20*c*, see FIG. 1, releasable locking tabs 24*a*, 24*b* have been illustrated. The tabs 24*a*, 24*b* slidably receive mating surfaces on an associated sensor or detector head, such as the head 20*a*.

The system 10 also includes an end-of-line circuit 28. The end-of-line circuit 28 provides information to the panel 12 as to whether or not one or more heads, such as the head 20*a*, have been removed from an associated base.

Figure 2:
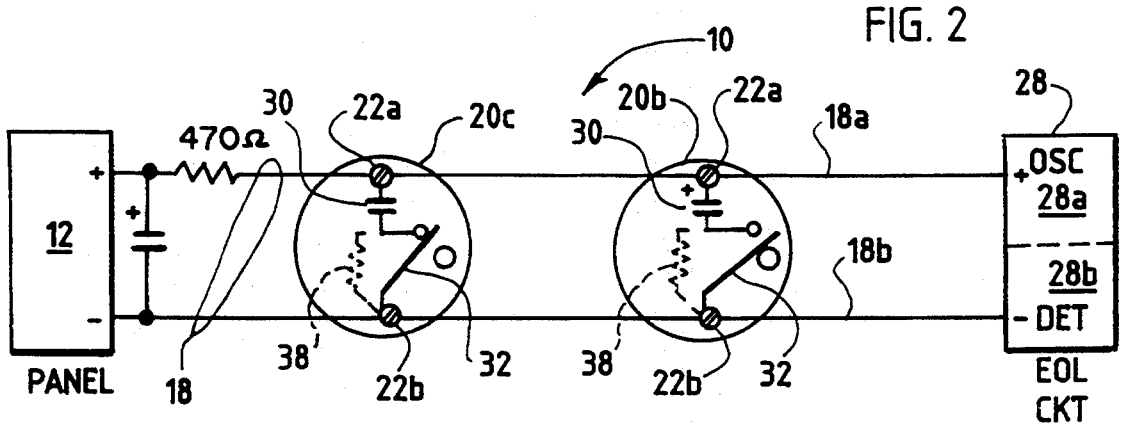
FIG. 2 is an overall block diagram of a first embodiment of the system of FIG. 1.

FIG. 2 is a schematic illustrating connectivity of the system 10. As illustrated in FIG. 2, the panel 12 is coupled via conductors 18*a*, 18*b* to detector bases 20*b*, 20*c*. The detector bases 20*b*, 20*c* are identical. The base 20*c* includes a storage element 30, a capacitor, which is coupled to terminal 22*a*. The detector base 20*b* includes a similar storage element.

The base 20*c* also includes a conducting spring member 32 which has first and second positions. The spring member 32 is illustrated carried on the base 20*c* and electrically coupled to the terminal 22*b*.

In FIG. 2, the spring member 32 is illustrated in one of its two positions. On the detector base 20*b*, the spring member 32 is illustrated in the other of its two positions.

The difference between the detector base 20*b* and the detector base 20*c* is that the head 20*a* has been installed on the detector base 20*b*. As a result, the spring member 32 is held adjacent to a stop 34 and is not in electrical contact with the capacitor 30.

On the other hand, in the base 20*c*, the spring member 32 is illustrated in electrical contact with the capacitor 32 in response to removal of the associated detector head, such as the head 20*a*.

An optional resistor 38, illustrated in phantom, can be coupled between one of the leads of the capacitor 30 and the terminal 22*b*. The resistor 38 provides an electrical pathway so that the capacitor 30 is fully charged up, even in the presence of the detector head 20*a*.

The end-of-line circuit 28, as illustrated in FIG. 2, has two major subcomponents. A first major subcomponent 28*a* is an oscillator for providing current pulses to the lines 18 on a repetitive basis. For example, the oscillator 28*a* could generate a 50 milliamp current pulse on the order of 5 milliseconds in duration every 3 seconds. It will be understood that the exact details of the oscillator 28*a* are not a limitation of the present invention.

A second component 28*b* of the end-of-line circuit 28 is a detector circuit which is capable of detecting a change in voltage across the lines 18, due to the current pulses from the oscillator 28*a*. The change in voltage is dependent on the presence or absence of the detector heads, such as the detector head 28 on the respective bases.

If all detector heads are installed on their respective bases, as illustrated with respect to the base 20*b* in FIG. 2, the capacitors 30 are connected across the lines 18*a*–18*b* through an associated resistor 38, if the resistor is present. Without an associated resistor 38, the respective capacitors are open circuited. In this arrangement, there is very little effective capacitance across the lines 18*a*, 18*b*. As a result, current pulses from the oscillator 28*a* can produce a substantial voltage pulse across the lines 18*a*–18*b*, which can be detected by the detector circuit 28*b*.

On the other hand, if one or more of the detector heads, such as the detector head 20*a*, have been removed, as illustrated with respect to the base 20*c*, the respective capacitors, such as the capacitor 30, are now directly coupled across the lines 18*a*, 18*b* by the spring member 32. As a result, current pulses generated by the oscillator 28*a* on the line 18*a*, will produce a substantially smaller voltage pulse variation across the lines 18*a*–18*b*. This reduced variation can also be sensed by the detector 28*b*. The reduced pulse variation is a positive and definite indicator that one or more of the detector heads, such as the head 20*a*, have been removed from a respective base.

For example, if each of the capacitors 30 has a capacitance of 10 microfarads, pulsing the lines 18*a*, 18*b* with a 50 milliamp current pulse for 5 milliseconds produces a 2½ volt pulse On the other hand, if all of the detector heads are installed on their respective bases, due to the small amount of capacitance in the system, it has been found that a 50 milliamp current pulse for 5 milliseconds can produce a 12 volt variation across the lines 18*a*, 18*b*.

If more than one detector has been removed from its respective base, the voltage variation becomes successively less. Each detector head which is removed introduces an additional capacitive element 30 in parallel across the lines 18*a*, 18*b*.

Figure 3:
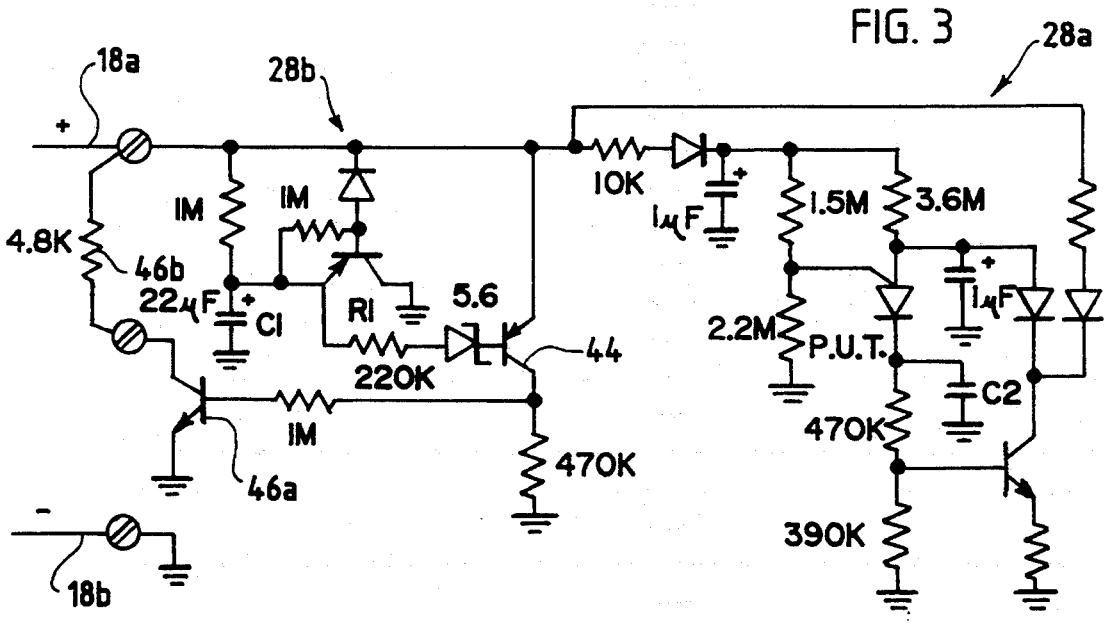
FIG. 3 is a schematic of end-of-line circuitry usable with the embodiment of FIG. 2.

FIG. 3 is a schematic of an exemplary oscillator 28*a*, which incorporates a programmable unijunction transistor. In addition, FIG. 3 is a schematic of an exemplary detector circuit 28*b* which utilizes a Zener diode to, in part, establish a detection threshold. The detector circuit 28*b* is synchronized with the oscillator circuit 28*a* by means of a transistor 44.

The detector circuit 28*b* is coupled across the lines 18*a*, 18*b* via a transistor switch 46a and an end-of-line resistor 46*b*. Where one or more detector heads have been removed and the absence of that head or those heads has been detected in the circuit 28*b*, transistor 46a is switched to a conducting state to draw a current pulse through the lines 18*a*, 18*b*, which can in turn be detected by the panel 12. The magnitude of the current pulse is an indication to the panel 12 that one or more of the detector heads, such as the head 20*a*, have been removed.

Figure 4:
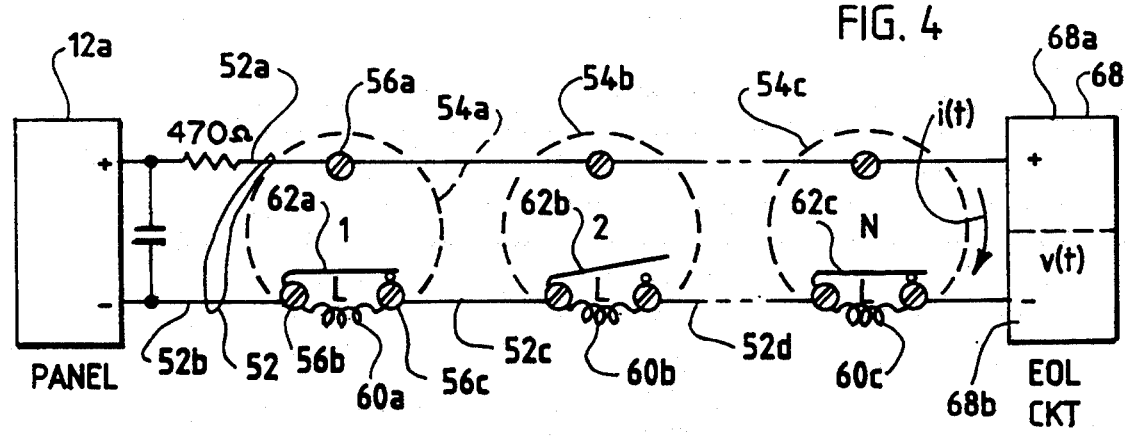
FIG. 4 is an overall block diagram of a second embodiment of the system of FIG. 1.

FIG. 4 illustrates, as an alternate embodiment, a system 50 which incudes a central control panel 12*a*. The panel 12*a* is coupled via conductors 52 to a plurality of detector bases 54*a*, 54*b*, and 54*c*.

The detector bases 54*a* and 54*c* are illustrated with the respective sensor or detector heads, such as the detector head 20*a*, installed. The base 54*b* has been illustrated with the respective detector or sensor head removed.

Each of the bases, such as the base 54*a*, includes a first terminal 56*a*, which is in turn coupled to a conductor 52*a*, as well as second and third terminals, 56*b* and 56*c*.

Each of the detector bases 54*a*, 54*b*, and 54*c* carries a storage element in the form of an inductor, such as the respective inductors 60*a*, 60*b*, and 60*c*. Each of the inductors, such as the inductor 60*a*, is coupled across two of the terminals, such as the terminals 56*b* and 56*c*, of the respective base.

One of the terminals, 56*b* for example, is coupled to the communication line 52*b*. The other of the terminals, such as 56*c*, is coupled to a portion 52*c* of the communication line 52b, which extends to the subsequent detector base, the base 54b. Between the base 54b and the base 54c, there is a further conducting segment 52d, as illustrated in FIG. 4.

Also carried on each of the bases, such as the base 54a, is a conductive spring member, such as the member 62a. The spring members, such as the member 62a, each have first and second positions. Each spring member is coupled to a respective terminal, such as the terminal 56b of the base 54a.

When a detector or sensor head, such as the head 20a, is installed on a respective base, such as the base 54a, the respective spring member, such as the member 62a, is located in a first position which electrically shorts the terminals, such as the terminals 56b and 56c. In this condition, the respective storage element 60a does not affect circuit operation.

When the respective sensor or detector head is removed from the respective base, such as the base 54b, the respective spring member, such as the member 62b, moves to a second position in response thereto, away from the respective terminal, such as the terminal 56c. In this condition, the storage element 60b is electrically coupled between the communication line segments 52c and 52d, and affects circuit operation.

The system 50 also includes an end-of-line circuit 68. The end-of-line circuit 68 is coupled across the conductors 52. It includes an oscillator section 68a and a detector section 68b.

The oscillator section 68a generates current pulses at a frequency on the order of 100 KHz. When all of the detector heads are installed on a respective basis, all of the respective inductors, such as the inductor 60a, are shorted by respective shorting springs. The detector circuitry 68b will not detect any inductively induced voltage in the lines 52.

On the other hand, if one or more of the detector or sensor heads, such as the head 20a, is removed from the respective base, the respective inductor, such as the inductor 60a, will be coupled between conductive segments 52b and 52c of the conductors 52. As a result, the current waveform generated by the oscillator 68a will produce a detectable inductively induced voltage in the lines 52. Hence, the end-of-line device 68 can provide an appropriate current signal to the panel 12a that one or more of the detector heads is missing.

For a value of inductance of the inductor 60a on the order of 1 millihenry, a variation in excess of 11 volts can be generated by the oscillator 68a. If the value of inductance of the inductor 60a is increased to 10 millihenrys, a voltage variation on the order of 45 volts can be observed. Hence, a signal indicative of the absence of one or more of the detector heads can be supplied to the panel 12a.

The spring members, such as the members 62a, 62b, 62c, can be eliminated if the respective detector head, such as the head 20a, shorts the respective terminals, such as the terminals 56b, 56c, when installed. In this embodiment, the base need only carry an energy storage element.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A detector comprising:

a sensing head;

a base engagable with and removable from said head wherein said base carries at least first and second terminals, and wherein said head is coupled to said terminals when so engaged, said base further including an energy storage element coupled to at least one of said terminals, wherein removal of said head from said base electrically connects said energy storage element between said terminals; and a spring member having first and second positions wherein said spring member is coupled to one of said terminals and moves, responsive to said head being removed from said base, from one of said positions to the other of said positions to generate an electrical signal indicative thereof;

wherein said element includes a capacitor having first and second leads wherein one of said leads is coupled to one of said terminals and wherein said spring member is coupled to another of said terminals, said member being in said first position displaced from another of said leads when said head is engaged with said base, and wherein said member moves to said second position in contact with said other lead in response to said head being removed from said base.

2. A detector as in claim 1 further including a resistor coupled between said second lead and said second terminal.

3. A detector as in claim 1 wherein said spring member is coupled in series with said capacitor across said terminals in the absence of said head.

4. A method of detecting separation of first and second parts of a two-part electrical unit wherein the second part carries first and second conductors, the method comprising:

pulsing the conductors with a first, electrical signal;

sensing a second electrical signal associated with the conductors indicative of the engagement of the first and second parts;

switching one of a capacitive or an inductive energy storage element into electrical conduction with the conductors as the first part is disengaged from the second part; and detecting a change in the second electrical signal indicative of the disengagement of the first part from the second part.

5. A method as in claim 4 further including, subsequent to the detecting step, producing an indicium indicative of the disengagement of the first and second parts.

6. A two-part electrical unit comprising:

a first part;

a second part which carries at least first and second electrical terminals and wherein said first part removably engages said second part;

a switch carried by said second part, coupled to said first terminal and responsive to said first part having engaged said second part; and an energy storage element which includes either a capacitor or an inductor, coupled to at least said second terminal such that in response to said first part not engaging said second part said energy storage element provides an electrical path between said first and second terminals and in response to said first part engaging said second part, said electrical path is not provided.

7. A two-part unit as in claim 6 wherein said energy storage element is connected in series between said terminals in response to said first part not engaging said second part.

8. A detector comprising:

a sensing head;

a base engagable with and removable from said head wherein said base carries at least first and second terminals, and wherein said head is coupled to said terminals when so engaged, said base further including an energy storage element coupled to at least one of said terminals, wherein removal of said head from said base electrically connects said energy storage element between said terminals; and a spring member having first and second positions wherein said spring member is coupled to one of said terminals and moves, responsible to said head being removed from said base, from one of said positions to the other of said positions and wherein said element includes an inductor having first and second leads and said base includes a third terminal and wherein said inductor leads are coupled to said second and third terminals such that said member is coupled across said second and third terminals, in said first position, in the presence of said head and wherein said member moves to said second position, away from one of said second or third terminals, in response to said head being removed from said base.

9. A detector as in claim 8 wherein said spring member is coupled in parallel across said inductor in response to the presence of said head.

10. An apparatus for detecting separation of first and second parts of a two-part electrical unit wherein the second part carries first and second conductors, the apparatus comprising:

means for pulsing the conductors with a first, electrical signal;

means for sensing a second electrical signal associated with the conductors indicative of the engagement of the first and second parts;

means for switching one of a capacitive or an inductive energy storage element into electrical conduction with the conductors as the first part is disengaged from the second part; and means for detecting a change in the second electrical signal indicative of the disengagement of the first part from the second part.

* * * * *